US006394874B1

(12) United States Patent
Kubo et al.

(10) Patent No.: US 6,394,874 B1
(45) Date of Patent: May 28, 2002

(54) APPARATUS AND METHOD OF USE FOR SOUND-GENERATING FINGER PUPPET

(75) Inventors: Takao Kubo, Tokyo (JP); Todd Miller Lustgarten, Chicago, IL (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/497,951

(22) Filed: Feb. 4, 2000

(51) Int. Cl.[7] ..... A63H 3/14
(52) U.S. Cl. ..... 446/327; 446/321; 446/391
(58) Field of Search ..... 446/321, 327, 446/328, 391, 394, 100

(56) References Cited

U.S. PATENT DOCUMENTS 4,687,457 A 8/1987 Milner
4,695,265 A * 9/1987 Clark ..... 446/329
5,447,461 A 9/1995 Liao
5,498,189 A * 3/1996 Townsend ..... 446/100

* cited by examiner

*Primary Examiner*—Kien T. Nguyen
(74) *Attorney, Agent, or Firm*—Fitch, Even, Tabin & Flannery

(57) ABSTRACT

A sound-generating finger puppet wherein more than one such puppet can be supported and activated with a single hand. Also provided is a sound-generating finger puppet wherein such puppet can be supported and primarily activated with a single finger. Also provided is a method for producing electronic sound generation in a puppet supportable on a single finger.

9 Claims, 3 Drawing Sheets

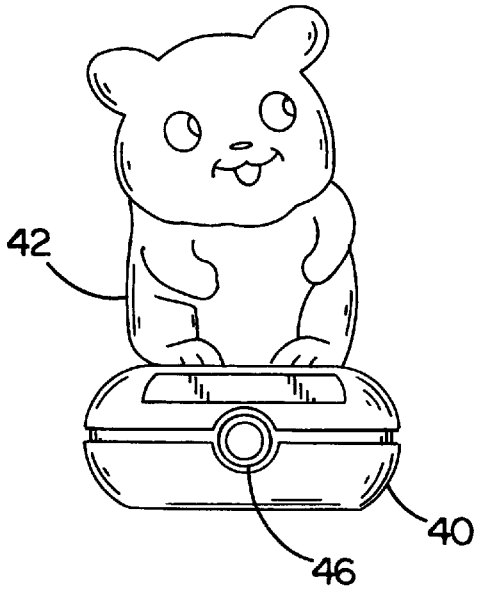
FIG. 5
FIG. 6
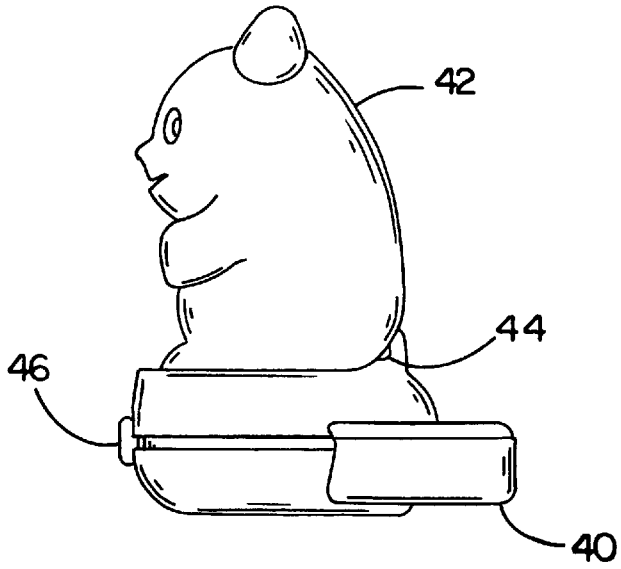
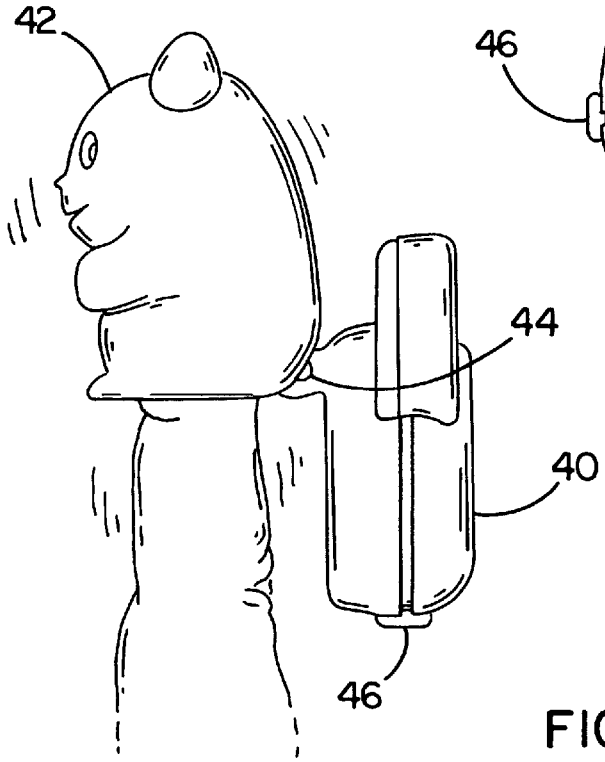
FIG. 7

APPARATUS AND METHOD OF USE FOR SOUND-GENERATING FINGER PUPPET

BACKGROUND OF THE INVENTION

Modern technology has facilitated the improvement of a wide variety of toys. Examples of the technological enhancement of well-known toys are numerous and include balls that illuminate or measure their velocities when thrown, radio-controlled toy cars having increased receiver range, and board games with LCD, LED, or even video displays.

Dolls, action figures, puppets, and the like have long been among the most popular toys, especially among younger children. One type of well-known toy is a doll that "speaks" or emits other sounds when a particular action is taken by the user, such as by pulling a cord to activate an internal tape player. Other means of eliciting particular reactions, sound-related or otherwise, from such dolls have generally included the activation of one or more of a variety of sensors located on the bodies of the dolls.

Finger puppets offer many of the same persona-like qualities associated with larger puppets, dolls, or action figures while having additional benefits. A significant benefit of finger puppets is that, due to their smaller size and their ability to be disposed on and supported by a single finger, a user may hold, and in fact play with, several finger puppets simultaneously. A child might, for example, place five or six such puppets on various fingers and imagine or verbalize a conversation among the personas represented by the finger puppets. In such an instance, the child might wiggle or bend the finger supporting the puppet representing a particular persona while uttering or imagining what that persona would say in such a conversation, to create the semblance of the finger puppet actually verbalizing.

As indicated, certain puppets, dolls, and action figures can be made to produce sounds, even sounds representing speech, and the mechanisms for actuating the sounds vary considerably. U.S. Pat. No. 5,447,461, for example, discloses a sound-generating hand puppet wherein manually pivoting the jaws of the puppet activates a sound-producing integrated circuit to imitate an animal cry, shouting, singing, or a human voice. Another example of a hand-held puppet having sound generation capability is shown in U.S. Pat. No. 4,687,457. The puppet disclosed therein includes a circuit for producing a tone having a pseudo-randomly varying audio frequency and a modulator to coordinate sound with the hand-controlled animation of the puppet. These puppets require, however, that the entire hand be used to support the puppets and activate the sound-producing circuits; thus, a user could, at most utilize two such puppets simultaneously, one on each hand. This is a less than satisfactory situation for individual users who want to play with more than two puppets at once or where it is desired to have more than one persona represented by each available hand among a group of puppeteers.

SUMMARY OF THE INVENTION

The present invention therefore provides a sound-generating finger puppet wherein more than one such puppet can be supported and activated with a single hand. The present invention also provides a sound-generating finger puppet wherein such puppet can be supported and primarily activated with a single finger. The present invention also includes a method for producing electronic sound generation in a puppet supportable on a single finger.

In one embodiment of the invention there is provided a finger puppet having electronic sound-generation capability.

The finger puppet includes a finger puppet body defining a hole for accommodating an inserted finger therein, an electronic sound chip disposed within the body for generating an electronic signal upon activation thereof, an activation switch for activating the electronic sound chip, and a speaker for receiving the electronic signal from the sound chip and producing a sound corresponding to the signal.

In another embodiment of the invention there is provided a sound-generating finger puppet supportable on and activatable primarily with a single finger. The puppet includes a finger puppet body defining a hole for accommodating an inserted finger therein and sound-generating apparatus disposed within the body for generating sound upon activation thereof. The inserted finger is generally capable of activating the sound-generating apparatus while remaining inserted in the hole in the finger puppet body.

In yet another embodiment of the invention there is provided a method for activating electronic sound generation in a finger puppet. The finger puppet includes a body defining a hole therein for accommodating an inserted finger from a user's hand. The puppet body further includes an electronic sound chip disposed therein for generating an electronic signal upon activation thereof. The puppet body further includes a speaker for receiving the electronic signal from the sound chip and producing a sound corresponding to the signal, and a button for activating the electronic sound chip. The button is disposed on a side of the hole. The method includes the steps of inserting a finger into the hole such that a portion of the finger is adjacent the button, bending the finger until the finger portion contacts the button and the finger puppet body rotates into contact with a portion of the user's hand other than the finger portion contacting the button, and depressing the button with the finger portion relative to the finger puppet body to activate the electronic sound chip, thereby producing sound from the speaker. The relative depressing is enabled by the contact between the finger puppet body and the portion of the user's hand supporting the body against pressure exerted against the button by the portion of the finger.

BRIEF DESCRIPTION OF THE DRAWINGS

FIG. 5 is a front view of a finger puppet in accordance with a second embodiment of the invention.

FIG. 6 is a side view of the embodiment shown in FIG. 5.

FIG. 7 is a side view of the embodiment shown in FIG. 5 wherein the base is rotated away from the body and a finger is inserted into the body.

DETAILED DESCRIPTION OF PREFERRED EMBODIMENTS

The present invention provides a sound-generating finger puppet. The finger puppet is supportable on a single finger and is activatable without the assistance of a hand other than the one on which the finger puppet is supported. Rather, the inventive finger puppet may have its sound generating mechanism activated by the mere bending of the supporting finger, without assistance from another hand or even portions of the supporting hand other than the supporting finger.

Figure 1:
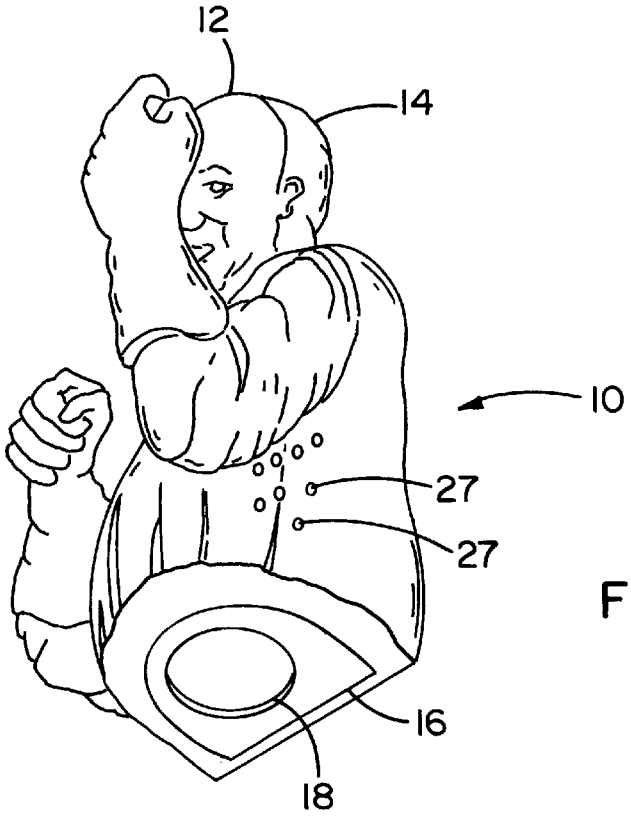
FIG. 1 is a perspective view of a finger puppet in accordance with a first embodiment of the invention.
Figure 2:
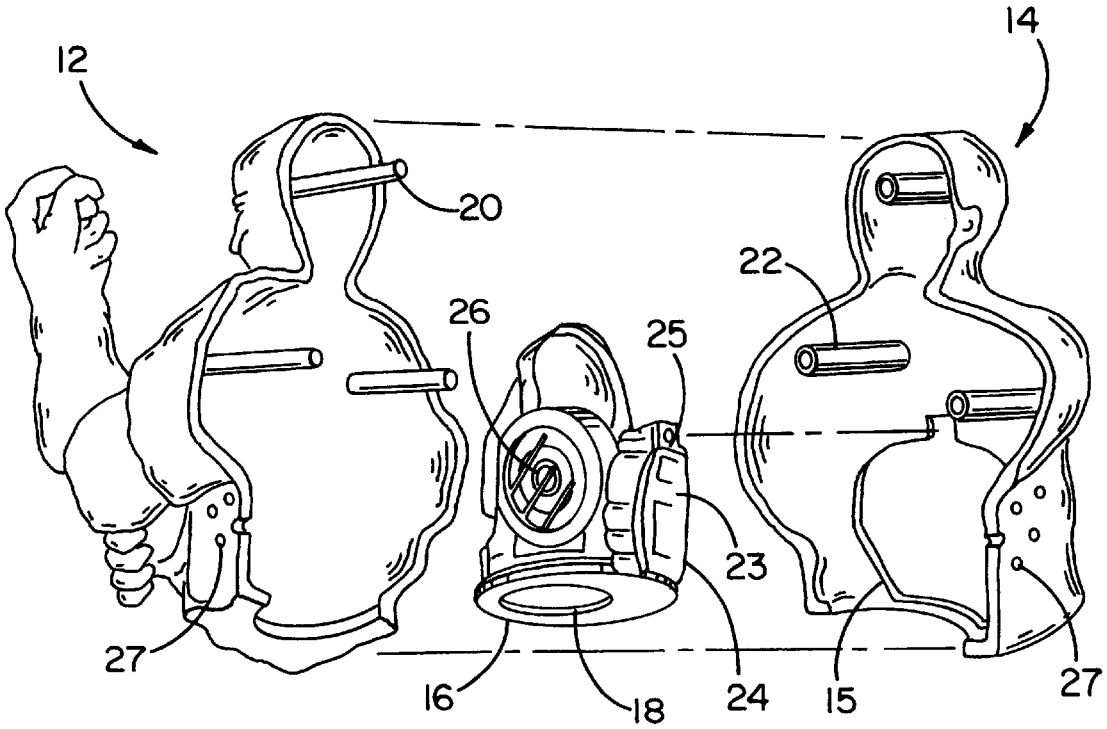
FIG. 2 is an exploded perspective view of a finger puppet in accordance with the invention wherein the exploded parts thereof are rotated relative to their assembled orientation to facilitate viewing of internal portions thereof.

A preferred embodiment of the inventive finger puppet is shown in FIGS. 1–4. FIG. 1 shows an assembled finger puppet 10 in accordance with the invention, while FIG. 2 shows the finger puppet 10 in a partially disassembled configuration. As seen there, the finger puppet 10 includes a front molded portion 12, a rear molded portion 14 and a molded finger tube 16. The molded pieces, the front portion 12, the rear portion 14, and the finger tube 16, are preferably molded into a generally rigid form, and they may be made of any suitable material, such as an appropriate thermoplastic or the like. As seen in FIG. 2, the front molded portion 12 includes rearwardly projecting male alignment members 20 for aligning and mating with complimentarily shaped and forwardly projecting female alignment members 22 on the rear molded portion 14. The finger tube 16 has a base portion generally defining a finger aperture 18 and a generally finger shaped portion for accommodating the insertion of a finger therein. During assembly of the finger puppet, the finger tube 16 is sandwiched between the front and rear portions 12 and 14. After the molded pieces are brought together during manufacture, the pieces are permanently affixed to one another (with adhesive or any appropriate affixing means) in the illustrated configuration to form the integral finger puppet 10. The puppet would then typically be painted or otherwise decorated.

In the illustrated embodiment, the finger tube 16 has a battery compartment 24 disposed on an external side of the finger shaped portion thereof for the retention of batteries therein. Also disposed on an external side of the finger shaped portion of the tube 16 are a speaker 26 and a microchip (not shown) capable of producing electrical signals convertible by the speaker 26 into sound. Internally, the finger tube 16 includes a button 28 on a side thereof (shown schematically in FIGS. 3 and 4), and the battery compartment 24 is connected to the microchip, speaker 26 and button 28 by wire, so that the microchip and speaker may be activated with power from the battery compartment when the button 28 is actuated. When the button is depressed, an electrical circuit is closed wherein the microchip provides a signal to the speaker, which the speaker interprets vibrationally into a repeatable sound pattern. The microchip may repeat a single sound signal each time it is activated, or may choose one of multiple signals for which it is programmed. Preferably, the sound pattern(s) producible by a particular microchip correspond with the persona visually identifiable from the puppet. Depending upon the orientation of the speaker 26, the front molded portion 12, the rear molded portion 14, or both portions may include speaker holes 27 therein for enabling the speaker to be better heard from outside the assembled finger puppet.

The battery compartment 24 has a battery compartment cover 23 for enclosing batteries within the compartment. When the batteries need replacing, a screw 25 can be removed to open the cover 23 and can be subsequently replaced, after the batteries are changed, to reclose the cover. When the finger puppet 10 is assembled, the battery compartment cover 23 comes flush with the rear molded portion 14 by fitting into a battery cover aperture 15 in the rear molded portion 14. In this manner, the batteries can be changed through the rear molded portion 14 because the finished product is not intended to have its molded pieces and/or finger tube separated from each other.

Figure 3:
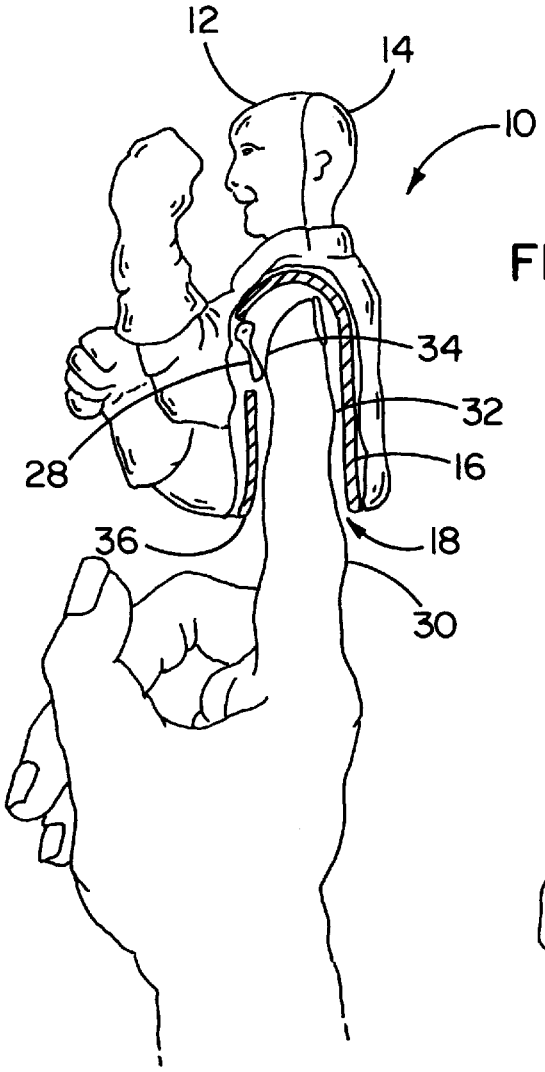
FIG. 3 is a schematic view of a finger puppet in accordance with an embodiment of the invention supported on an upright finger.
Figure 4:
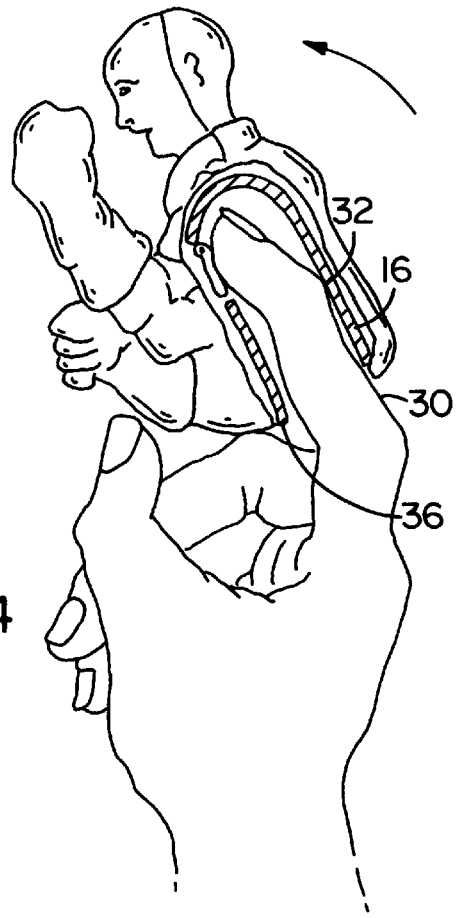
FIG. 4 is a schematic view of the finger puppet of FIG. 3 supported on a bent finger to illustrate how sound-generating apparatus may be activated in this embodiment of the invention.

Referring now primarily to FIGS. 3 and 4, the finger puppet 10 is shown schematically disposed on a human index finger. Any finger, or even a thumb, could be used to support and activate the puppet if the finger aperture 18 and the cross section of the tube 16 are sized appropriately. In FIG. 3, the puppet 10 is being supported vertically by a finger 30. Although the finger tip may reach the end of the tube 16 to provide support, friction between the sides of the finger and the interior surface of the tube 16 preferably provides adequate support for the puppet.

One manner in which one can actuate the sound-emitting apparatus of the finger puppet 10 is shown schematically in FIG. 4. In particular, the finger 30 is bent forwardly with its top knuckle 32 leveraged against the inner surface of the tube 16. This permits the top portion of the finger, and particularly a contact portion 34 thereof, to rotate forwardly and meet the button 28 disposed in the interior of the tube.

As shown, in FIG. 3, the button 28 is preferably recessed or protruding inwardly into the interior of the tube prior to actuation while actuation involves biasing the button back toward the wall of the tube. It is contemplated within the scope of the invention that the button can be a switch of any kind having a binary condition wherein an electrical circuit is open or closed, and it is not necessary that the button conform to the one illustrated in schematic FIGS. 3 and 4. Counter force against the action of pressing on the button may be provided by use of another hand to hold the puppet, contact of the front lip 36 of the tube 16 against the base of the finger 30 caused by the rotation of the puppet, or, as shown in FIG. 4, contact between the puppet and another portion of the hand (such as an adjacent finger). These latter two modes of use are important features of the invention because they permit the user to actuate multiple sound-emitting puppets easily and without needing another hand or any other external item to provide counterforce.

As seen in the figures, the finger puppet generally rotates forwardly as the contact portion 34 of the finger 30 depresses the button 28 to actuate the sound-emitting apparatus. The simultaneous rotation and sound emission creates the impression that the persona represented by the finger puppet is bowing or otherwise moving his/her head to speak, thereby providing an effect that enhances the realism of the personas. Another preferred embodiment of the invention is shown in FIGS. 5–7. In particular, this embodiment includes a base portion 40 pivotally attached to the puppet body 42 such that pivoting of the base portion 40 relative to the body 42 opens and closes access to the finger hole. In a closed position, the base portion 40 can serve as a stand for the finger puppet, such as when the finger puppet is being displayed on a shelf or piece of furniture. To reach the open position, the base portion 40 pivots around an axis 44 disposed near the lower rear portion of the body 42.

In this embodiment, the base portion 40 may also carry a battery compartment, the sound chip, and the speaker, as well as corresponding speaker holes in the casing, to remove bulk and weight from the body of the finger puppet. This permits a smaller, lighter body portion which may be more appropriately sized to a child's finger particularly. The base portion preferably also has an additional button 46 for actuating the sound chip. This button enables the sound chip to be activated while the base portion 46 is closed over the finger access hole, such as when the finger puppet is being displayed.

It is important to note that the embodiment described above and shown in the figures represents a single embodiment of the invention, and a significant range of alternative embodiments is contemplated to be within the scope of the invention. Without being exhaustive, the following list identifies examples of non-limiting aspects of the previously described embodiment and some specific alternatives considered to be within the scope of the invention: the puppet need not be molded at all or can be molded into a single piece; the battery compartment, speaker and microchip need not be disposed on the finger tube, but may be disposed anywhere inside or outside the body of the puppet; the puppet need not accommodate only a single finger, but rather may accommodate the insertion of multiple fingers and may provide multiple buttons for the actuation of different sounds from the microchip/speaker combination; and the sound emission need not be speech corresponding to a persona, but rather may alternatively be or include special effects sounds appropriate for the persona.

The invention is described in the following claims:

What is claimed is:

1. A finger puppet having electronic sound-generation capability, said finger puppet comprising:

a finger puppet body defining a hole for accommodating an inserted finger therein;

an electronic sound chip for generating an electronic signal upon activation thereof;

an activation switch in electronic communication with said sound chip for activating said sound chip;

a speaker in electronic communication with said sound chip for receiving said electronic signal from said sound chip and producing a sound corresponding to said signal; and further comprising a base portion pivotally attached to said puppet body wherein pivoting of said base portion relative to said body opens and closes access to said hole.

2. A finger puppet in accordance with claim 1 wherein said speaker is disposed in said body and said body defines a plurality of speaker holes therein such that sound produced by said speaker can more easily be heard.

3. A finger puppet in accordance with claim 2 wherein said activation switch includes a button disposed within said hole such that depressing said button with said finger activates said electronic sound chip, thereby producing sound from said speaker.

4. A finger puppet in accordance with claim 1 wherein said activation switch includes a button disposed within said hole such that depressing said button with said finger activates said electronic sound chip, thereby producing sound from said speaker.

5. A finger puppet is accordance with claim 1 wherein said base portion houses said sound chip and said speaker.

6. A finger puppet in accordance with claim 1 wherein said activation switch includes a button disposed on said base portion.

7. A finger puppet in accordance with claim 6 wherein said activation switch includes both a button disposed on said base portion and a button disposed within said hole such that depressing either button activates said electronic sound chip, thereby producing sound from said speaker.

8. A method for activating electronic sound generation in a finger puppet, said finger puppet including a body defining a hole therein for accommodating an inserted finger from a user's hand, said puppet body further including an electronic sound chip disposed therein for generating an electronic signal upon activation thereof, said puppet body further including a speaker for receiving said electronic signal from said sound chip and producing a sound corresponding to said signal, and said puppet body further including a button for activating said electronic sound chip, said button being disposed on a side of said hole, said method comprising the following steps:

inserting a finger into said hole such that a portion of said finger is adjacent said button and said finger puppet is supported on said finger;

bending said finger until said finger portion contacts said button and said finger puppet body rotates into contact with a portion of said user's hand other than said finger portion contacting said button; and depressing said button with said finger portion relative to said finger puppet body to activate said electronic sound chip, thereby producing sound from said speaker, wherein said depressing is enabled by said contact between said finger puppet body and said portion of said user's hand supporting said body against pressure exerted against said button by said finger portion.

9. A method in accordance with claim 8 wherein said finger puppet further includes a base portion pivotally attached to said puppet body to open and close access to said hole and said method includes the additional step, conducted prior to the inserting step, of pivoting said base portion relative to said puppet body to open access to said hole.

* * * * *